United States Patent [19]

Eeckhout

[11] 4,360,725

[45] Nov. 23, 1982

[54] OVERTEMPERATURE PROTECTOR FOR AN ELECTRICALLY HEATED APPLIANCE

[75] Inventor: Roger V. Eeckhout, Warminster, Pa.

[73] Assignee: SCM Corporation, New York, N.Y.

[21] Appl. No.: 127,683

[22] Filed: Mar. 6, 1980

[51] Int. Cl.[3] ..... H05B 1/02; H01H 37/76

[52] U.S. Cl. ..... 219/253; 219/517; 337/3; 337/299; 337/407; 337/411; 337/414

[58] Field of Search ..... 219/251–253, 219/517, 436, 437, 438, 441; 337/2, 3, 4, 6, 7, 1, 299, 375, 149, 401–416

[56] References Cited

U.S. PATENT DOCUMENTS

| | | | |
|---|---|---|---|
| 910,118 | 1/1909 | Crutchfield | 337/407 |
| 1,227,228 | 5/1917 | Woermer | 219/517 |
| 1,439,979 | 12/1922 | Richardson | 219/253 |
| 1,475,630 | 11/1923 | Herz | 219/517 X |
| 1,644,875 | 10/1927 | Dodge | 337/149 |
| 2,266,480 | 12/1941 | Steiner | 337/403 |
| 2,488,275 | 11/1949 | Du Pont | 337/403 |
| 2,707,217 | 4/1955 | Collins et al. | 337/410 |

FOREIGN PATENT DOCUMENTS

| | | | |
|---|---|---|---|
| 10947 | of 1928 | Australia | 337/411 |
| 15239 | of 1929 | Australia | 337/407 |
| 604189 | 8/1960 | Canada | 219/253 |
| 393943 | 4/1924 | Fed. Rep. of Germany | 219/438 |
| 2339674 | 2/1975 | Fed. Rep. of Germany | 219/253 |

*Primary Examiner*—A. Bartis

*Attorney, Agent, or Firm*—Armand G. Guibert; Ernest F. Weinberger

[57] ABSTRACT

An overtemperature protector for an appliance having an electrical heating element includes a fixed contact, a movable contact carried by a spring blade and settable into engagement with the fixed contact to complete the energizing circuit to the heating element by stressing the spring blade, and a torsion spring having an arm engageable with the spring blade to hold the contacts in engagement against the stress bias of the spring blade. A fusible pin retains the arm of the torsion spring in engagement with the spring blade, thus locking the contacts closed. Excessive heat in the appliance causes the pin to soften, thereby allowing the torsion spring to shear the pin and release the movable contact to open the heating element energizing circuit. The overtemperature protector can be integrated with the control thermostat assembly of the appliance by mounting the protector on an extension of one of the contact arms of the thermostat assembly and connecting the contacts of the overtemperature device in series with the thermostat assembly contacts.

19 Claims, 4 Drawing Figures

OVERTEMPERATURE PROTECTOR FOR AN ELECTRICALLY HEATED APPLIANCE

BACKGROUND OF THE INVENTION

1. Field of the Invention

This invention relates to improvements in overtemperature protectors for electrically heated appliances such as flat irons. More particularly, the invention relates to spring contacts held in circuit-making engagement by a torsion spring which is, in turn, held by a fusible pin.

2. Description of the Prior Art

In general, the use of fusible members in overtemperature protectors (also referred to in the art as "thermal cut-outs") is well-known. For example, U.S. Pat. Nos. 1,015,954; 1,364,122; 1,382,101; 1,439,979; 1,468,418; and 1,556,762 shows overtemperature protectors in connection with electric irons. Other appliances having overtemperature protectors of various types are disclosed in U.S. Pat. Nos. 1,615,742; 1,693,364; and 2,022,531. The earlier patents concerned with protection against thermal overloads generally disclose space-consuming arrangements and/or devices requiring sliding elements incorporating metal-to-metal interfaces. Because of the effects of corrosion—particularly important in steam irons—these safety devices may in time degrade to the point where they will fail to function when needed. Furthermore, some of the structures disclosed incorporate the fusible element in the electrical circuit—e.g., the above-mentioned U.S. Pat. No. 2,022,531 and a more recent U.S. Pat. No. 3,665,152; but, as pointed out in the latter patent, in such case it is not permissible to have the fusible element in direct metal-to-metal contact with the outer parts of the appliance—e.g. the sole plate of an electrical iron—which the user may handle. Accordingly, there is need of an improved structure which avoids these deficiencies yet provides simple, contact, and reliable long-term protection against thermal overloads.

SUMMARY OF THE INVENTION

It is a general aim of the present invention to provide a simple, low-cost overtemperature protector based on utilizing a torsion spring as a latch or lock member for circuit-making members.

Accordingly it is an aspect of the invention to provide an improved overtemperature protector in an electrical appliance having a heating element, the overtemperature protector comprising: a contact bearing member and a resilient blade having on it a further contact, one of the member and the blade being connected to a source of electrical power and the other being in circuit with the heating element; a base; structure on the base supporting the member and the blade with the further contact in opposed, spaced relationship with the first-mentioned contact, the further contact being settable into a normal, current-carrying relationship with the first-mentioned contact by stressing the blade; a torsion spring mounted on the base and having a fixed arm and a mobile arm, the mobile arm being movable from a rest position clear of the blade to a flexed position with the end of the mobile arm adjacent the blade at a point on the blade remote from the supporting structure; an insulator interposed between the point on the blade and the end of the mobile arm and effective to hold the contacts in their current-carrying relationship when the blade is stressed and the mobile arm is moved to the flexed position, and a fusible pin affixed to the base and blocking the mobile arm in the flexible position, such that excessive heating of the pin allows the torsion spring to shear the pin and release the blade.

It is a further aspect of the invention to provide an improved thermostat having an extension on one of the contact-making members in the power circuit to the heating element, the extension serving as part of a latchable switch element of an overtemperature protector comprising a torsion spring as the latch and a fusible pin operable as the temperature-sensitive release member for the latch.

DESCRIPTION OF THE PREFERRED EMBODIMENTS

Figure 1:
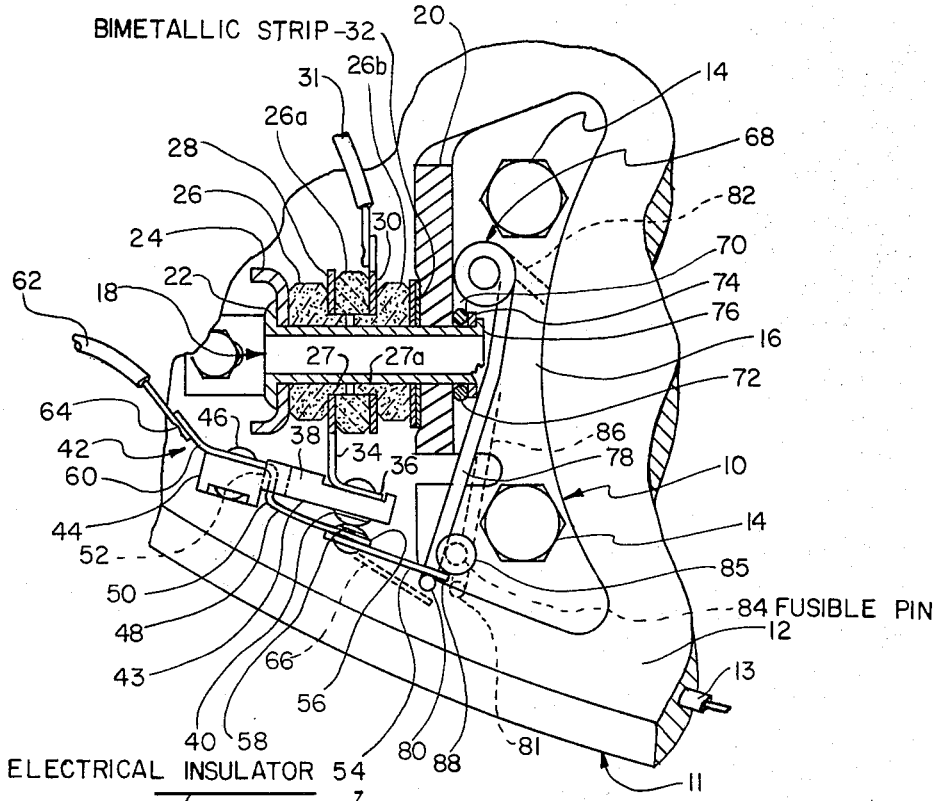
FIG. 1 is a plan view of a thermostatic control for an electric appliance, e.g., a flat iron, as modified to include an overtemperature protector according to a first embodiment of the invention.
Figure 4:
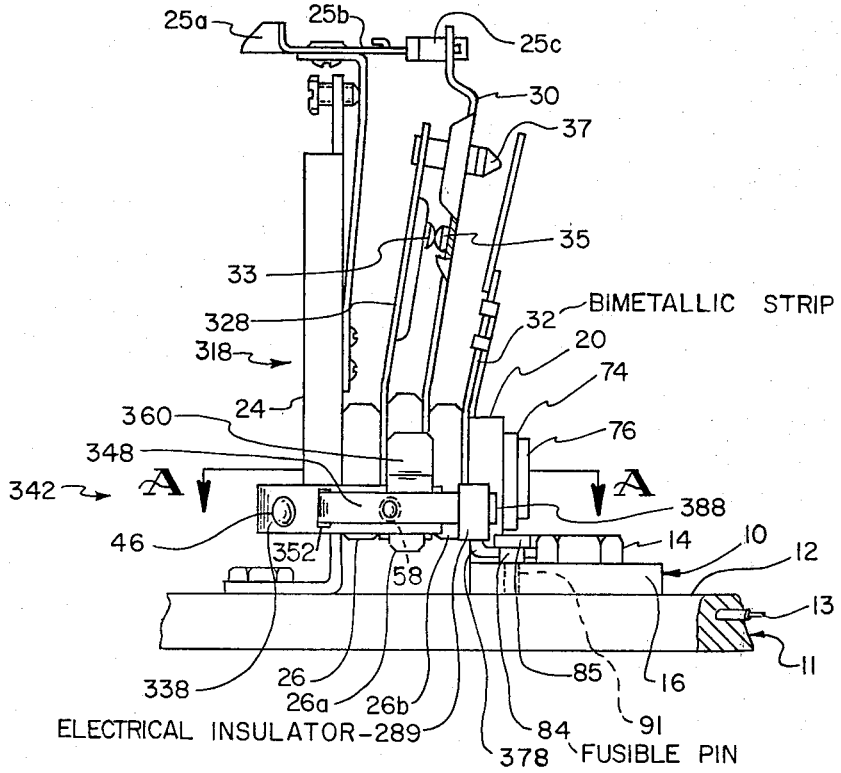
FIG. 4 is an elevation view of the modified thermostatic control of FIG. 3 (though the thermostatic elements are also typical of those present in the embodiments of FIGS. 1 and 2).

A detailed description of an overtemperature protector according to the invention will be given with respect to a first embodiment shown in FIG. 1. As seen in that figure, an angular bracket 10 supports a thermostat 18 modified to include current-carrying portions of an overtemperature protector 42, the release portions of which comprise a torsion spring 68 and a fusible pin 84. Bracket 10 is fastened to a heated surface 12 of an electric appliance such as a flat iron (upon which the remainder of the description is based for simplicity). Surface 12, then, forms the upper surface of the flat iron's sole plate 11 containing an electric heating element 13 (conventional, a known type being shown). Bracket 10 is clamped tightly to surface 12 by means of bolts 14 passing through the base 16 of bracket 10 and being threadedly engaged in sole plate 11 of the iron. The reason for the tight clamping stems from the fact that both thermostatic control 18 and overtemperature protector 42 (which it incorporates according to one aspect of the invention as will be described below) must accurately reflect the temperature of sole plate 11. The various elements of thermostat 18 (which is of conventional design except as will be indicated below) are all perforated and fastened (best seen in FIG. 4) to an upstanding portion 20 of bracket 10 by means of a tubular rivet 22 or "eyelet", as it will be referred to inhereafter for simplicity. Only the lower portions of thermostatic control 18 partially cut-away, are shown in FIG. 1 for greater clarity. The element of control 18 are a U-shaped arm 24 which supports the usual temperature adjusting members (conventional, as shown in FIG. 4) comprising selection knob **25*a*, cam plate 25*b* and insulating follower member 25*c* (this last being mounted on another thermostat element to be described subsequently), a first ceramic spacer 26 having a shoulder 27 (conventional, as visible in the cut-away view of FIG. 1) upon which is fitted a "make/break" blade 28 forming one part of the electrical circuit of thermostat 18 and actuated—as described briefly below—by a temperature-sensitive member in known fashion; a second, shoulderless ceramic spacer 26***a* (slip-fitted over shoulder 27 of spacer 26); a further blade 30 of thermostat 18, this further or "regulator" blade being settable to different positions by the temperature adjusting controls on support arm 24 to regulate the temperature and being mounted on a similar shoulder 27*a* (oppositely oriented, as visible in FIG. 1) on a third spacer 26*b;* and a temperature-sensitive bimetallic strip 32 separated from regulator blade 30 of thermostat 18 by the third spacer 26*b.* Blades 28, 30 respectively bear the usual electrical contacts 33, 35, blade 28 being biased to keep these contacts normally in engagement—i.e. closed circuit condition. Blade 30 is connected to a source of power (not shown) via a lead 31, the circuit condition thus controlling the supply of power to heating element 13. Bimetallic strip 32 is clamped directly against the upstanding portion 20 of bracket 10 for purposes of being in good thermal communication with the surface 12 of sole plate 11. In known fashion, as bimetallic strip 32 receives heat from surface 12 through bracket 10, it will deform due to differential expansion of the dissimilar metals of which it is made. Orientation of bimetallic strip 32 is such that deformation occurs toward make/-break blade 28, from which bimetallic strip 32 is electrically insulated (conventional). When the temperature of surface 12 (and, therefore, that of strip 32) rises sufficiently, make/break blade 28 is moved away from regulator blade 30, the circuit interruption occuring, as is known, at a lower or higher temperature depending upon the setting of the adjusting controls (knob 25*a,* etc., conventionally mounted on arm 24, as previously mentioned). It should be noted that while each embodiment of the overtemperature protector discloses it as a part of a thermostatic control, the overtemperature protector can be utilized separately wherever the temperature of some appliance cannot exceed a desired limit (pin 84 being made of an alloy suitable to the limit, of course).

According to the first embodiment of the invention (FIG. 1), make/break blade 28 has a lateral extension 34 with an angled end 36 supporting the switch elements of overtemperature protector 42, as will now be described. These elements comprise a ceramic switch body 38 rigidly fastened by a rivet 40 to the angled end 36 of extension 34 on blade 28. Rivet 40 also serves as an electrical contact, being made of silver or of copper alloy with a silver coating. At the opposite end 44 of ceramic body 38, a resilient blade 48 is rigidly fastened to one side of ceramic body 38 by an ordinary rivet 46. The form of blade 48 includes a jog 50 which permits blade 48 to have a portion lying roughly parallel to the opposite side 43 of body 38 upon being passed through an aperture 52 indicated by dotted lines in switch body 38. At its free end 56, resilient blade 48 has an insulator strip 54 securely fastened to it by a silver rivet 58 (which may also be of silver-plated copper alloy, as before), likewise serving as an electrical contact. In the position shown in solid lines in FIG. 1, the rivets 40 and 58 are touching—i.e., in electrically conducting engagement.

Adjacent to rivet 46, blade 48 is provided with a tab 60 connected to heating element 13. The connection may be made, for example, by means of a lead 62 spot-welded to tab 60 as indicated at 64. Alternatively, a push-type spring terminal could be provided. Obviously, lead 62 could be connected instead to the source of power, the actual circuit arrangement for current flow not being critical in this respect, except for considerations of shock hazard were the released blade 48 allowed to contact metal parts exposed to the user.

Blade 48 is so stressed that unless restrained, it tends to move from the closed circuit position shown in solid lines in FIG. 1 and assume the open circuit position 66 shown in dotted lines. In normal operation, then, resilient blade 48 is latched in the solid outline position by action (described subsequently) of torsion spring 68 fastened to bracket 10. For fastening purposes, torsion spring 68 has an arm 70 terminated with a ring 72, which ring is clamped to the upstanding portion 20 of bracket 10. The clamping force is exerted through a planar washer 74 by the die riveted end 76 of eyetlet 22. The other arm 78 of torsion spring 68 is positioned with its end 80 behind the insulator 54 thus providing the above-mentioned latching of resilient blade 48 in the solid line position. The end 80 is formed at right angles to arm 78 for this purpose. When arm 78 is in stressed condition (solid lines), it tends to swing counterclockwise to the unstressed condition (shown by the dotted line stub 82). It is held, however, in the stressed condition (solid lines) by abutment against a restraining pin 84 securely fastened in the base 16 of bracket 10 by press fitting pin 84 into a hole 91 in bracket 10 (other means of fastening—such as threads—could be used, of course). Pin 84 is fusible—being made of a low-melting metal, such as zinc or an alloy, for example—and has a lip 85 overlying arm 78 to prevent premature circuit interruption caused by shock—e.g. dropping the iron. If thermostatic control 18 jams or the power to the heating circuit of the flat iron is maintained unduly long for some other reason, the temperature of sole plate 11 rises toward the melting point of the material (usually aluminum). The fusible pin 84 melts first or, at least, softens sufficiently such that arm 78 can shear pin 84. In any event, arm 78 is then released to occupy either the unstressed position shown by stub 82 or the intermediate dotted line position 86 (still partially stressed) where it is occasionally stopped by bolt 14. In the released position 86 (or 82), the formed end 80 of arm 78 is at the dotted line position 81 (or beyond—i.e., clear of the end 88 of insulated extension 54 affixed to resilient blade 48 by contact rivet 58. Accordingly, resilient blade 48 no longer being latched, it will swing to the dotted line position 66, interrupting the electrical circuit to heating element 13 and thus preventing excessive heating of the iron with potential melting and creation of a hazardous situation for the user.

Figure 2:
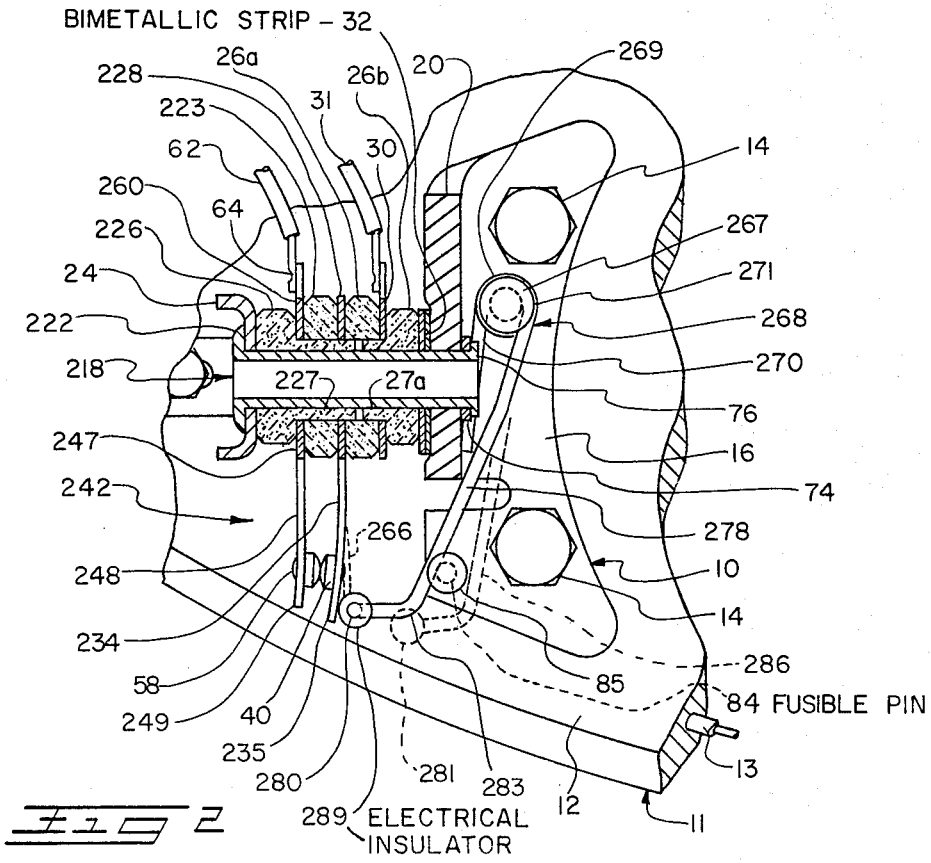
FIG. 2 is likewise a plan view of an alternative embodiment in whch a thermostatic control incorporates an overtemperature protector according to the invention.

While the above structure for the first embodiment of the invention is satisfactory in many respects, the second embodiment shown in FIG. 2 provides further simplication and reduced sensitivity to the accumulation of tolerances. In this second embodiment, the insulator 38 and blade 48 of the first embodiment are transferred in modified form to the assembly stack of the thermostat 218, modified as required to receive them, mainly through use of a longer eyelet 222. This transfer permits each contact-bearing element of the overtemperature protector 242 to be identical, linear and longer resilient cantilevered extensions 234, 248 respectively attached to make/break blade 228 of thermostat 218 and to a root section 247. The root section 247 is mounted between the leftmost (as viewed in FIG. 2) ceramic spacer 226 and an additional shoulderless spacer 223 (replacing insulator 38). Root section 247, spacer 223 and make/break blade 228 are all supported on a shoulder 227 of spacer 226. Further, at its upper end (again, as viewed in FIG. 2) root section 247 bears a tab 260 for connection to lead 62 from heating element 13 via a spot-weld 64, as before. The remainder of thermostat 18 is unchanged in this second embodiment.

Circuit-making engagement of contacts 40 and 58 on the respective cantilevered extensions 234 and 248 is provided by a slightly changed torsion spring 268. For simplicity, this last is mounted to the base 16 of bracket 10 by means of a shoulder rivet 267 inserted through the turns 269 of torsion spring 268, retained on bracket 10 by a lip 271 on shoulder rivet 267. The changed mounting simplifies arm 270 by dispensing with ring 72. Because location and length of the cantilevered extensions 234, 248 are changed as compared to the related members in the first embodiment, arm 278 is somewhat longer than arm 78 and includes a bend 283 near the formed end 280, the bend being required because the extensions 234, 248 are both straight, neither being angled like extension 34 of the first embodiment. End 280 is identical to end 80 of torsion spring 68 of the first embodiment, except for one difference—namely that the insulation for isolating spring 278 from the electrical circuit is now a cylindrical molded ceramic cap 289, adapted to slide freely over the end 280, to which it may be secured with an adhesive, for example. Cap 289 may also be formed on end 280 by direct molding and firing, if desired. Thus, when arm 278 is rotated clockwise (as viewed in FIG. 2) and brought to the left of the fusible restraining pin 84, this process causes cap 289 to engage the free end 235 of blade 234, bringing the contacts 40 and 58 together to establish the power circuit.

The above-described modified arrangement of FIG. 2 is an improvement over that of FIG. 1 because its eliminates some complexity of the elements in FIG. 1 and provides more flexible extensions 234 and 248, the additional flexibility serving two purposes; provision for overtravel when the torsion spring 268 is brought into the stressed position (solid lines) and provision for counterbalancing the accumulation of tolerances on other components. Other than the foregoing change, the operation of the overtemperature protector is essentially the same as previously described, except that the process of bringing arm 278 into the latching position (solid lines) automatically brings contacts 40, 58 into engagement, as mentioned above. Contrastingly, in the first embodiment the contacts 40, 58 first had to be brought into engagement manually and then arm 78 brought into locked position to the left of fusible pin 84 where the vertical end 80 fell behind extension 54 for latching the contacts 40, 58 in engagement. Also, in the arrangement of FIG. 2, when the fusible pin 84 melts or softens, the bias forces in spring 278 and extension 234 combine to shear pin 84, spring 278 then passing to the dotted line position 286 where the end 280 with its ceramic cap 289 is at the position 281, and the extension 234 moving to the dotted line position 266 where the power circuit is open.

Figure 3:
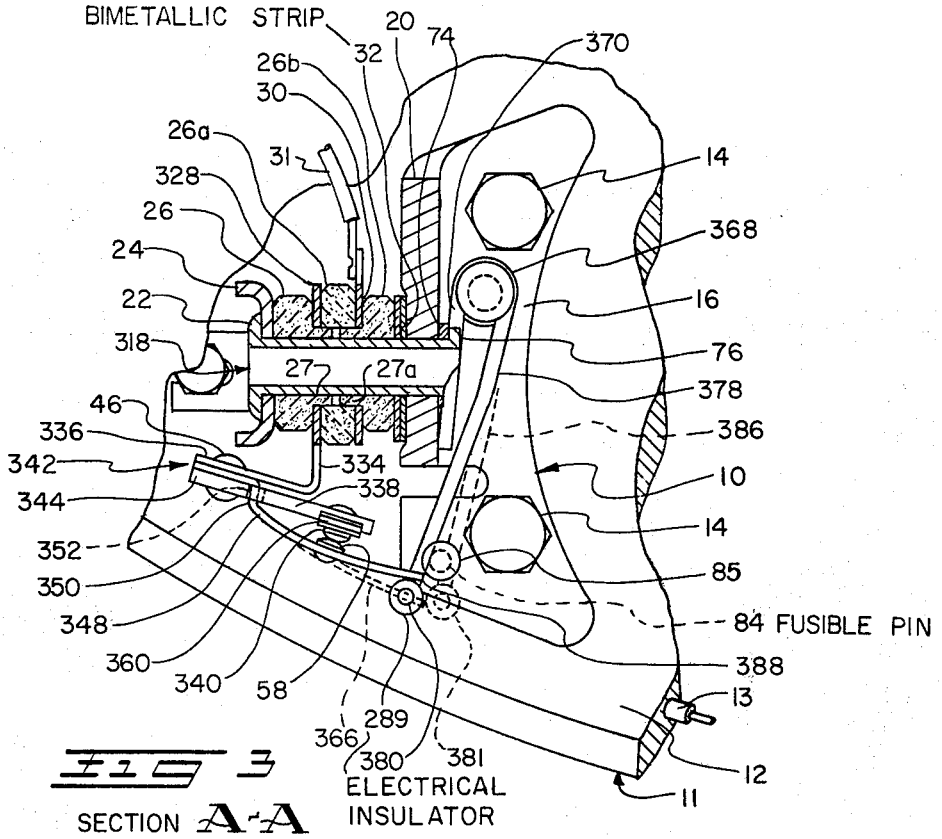
FIG. 3 is a plan view of yet a third embodiment in which a thermostatic control is modified to include an overtemperature protector according to the invention.

As seen, the structure of the second embodiment (FIG. 2), effects significant improvement in terms of simplification and lower cost, but still leaves something to be desired in that though it is possible to achieve the desired amount of contact force necessary to assure a good electrical circuit despite the range of part tolerances, the required length of cantilevered extensions 234, 248 consumes too much space and brings their respective ends 235, 249 too close to the covers in certain flat irons (not shown). Accordingly, combination of the best features of both embodiments leads to a third embodiment—the structure shown in FIG. 3—where the switch elements of the overtemperature protector 342 are akin to those of FIG. 1, while shape and mounting of the torsion spring 368 are more akin to that of FIG. 2. As seen in FIG. 3, the make/break blade 328 of a thermostat 318 has an angular lateral extension 334 bent to the left in contradistinction to the rightward bend in extension 34 of make/break blade 28 in FIG. 1, this change provides additional length for the end 336, thus affording greater flexure in extension 334, a flexure comparable to that afforded by blade 248 in the embodiment of FIG. 2. Similarly, blade 348 is longer than blade 48 of the first embodiment, being substantially equal in length to the combined lengths of blade 48 and its insulated extension 54. Blade 348 is otherwise quite similar to blade 48, having a jog 350 passing through an aperture 352 in the insulating ceramic switch body 338. In the present embodiment, the angled end 336 of extension 334, together with blade 348, is rigidly fastened to switch body 338 near its end 344 by an ordinary rivet 46 passing through appropriate perforations (not shown). A tab 360 is also fastened to the end of ceramic body 338 opposite that bearing rivet 46, tab 360 being held by a rivet 340 which again serves as an electrical contact, being made of silver or a copper alloy with a silver coating. Tab 360 (similar to the tab 60 of the first embodiment) is intended for connection to lead 62 by a spot-weld 64, though these last two are omitted in FIG. 3 to avoid diminished clarity.

The free end 388 of cantilevered blade 348 is obviously latched in much the same manner as previously described for the first embodiment, and thus only the barest details need be repeated at this point. An electrical contact 58, identical to that of FIG. 1, is affixed to blade 348 at a point such that manually moving blade 348 counterclockwise from the dotted line, unstressed position 366 brings contact 58 into contact with rivet 340 to establish a circuit. After slight overtravel to the solid line position in FIG. 3, the end 388 of blade 348 is so located that the formed end 380 of an arm 378 of torsion spring 368 can be turned clockwise to bring it behind the end 388 for latching purposes. Spring 368 is identical to that in FIG. 2 except for the absence of bend 283 and a corresponding decrease in length. The end 388 is part of the metal in blade 348 and therefore part of the electrical circuit. Accordingly, the latching action between end 380 and 388 is effected through a cylindrical, molded ceramic cap 289 identical to that disclosed in FIG. 2. As in the other two embodiments, the latching arm 378 of torsion spring 368 is restrained in the latching position (solid lines)—so long as the temperature of sole plate 11 is below the desired limit—by being placed to the left of fusible pin 84 under lip 85. If pin 84 melts or softens appreciably, arm 378 shears pin 84 while moving to the dotted line position 386 against bolt 14, the formed end 380 then being at the dotted line position 381 which clears the end 388 of blade 348. This last is thus released and moves to its unstressed position 366 (dotted lines), the power circuit again being interrupted.

The foregoing description of an overtemperature protector comprises a member 34 (234, 360) carrying a contact 40, a resilient blade 48 (248, 348) having a further contact 58, an insulator (which may be a switch body) 38 (223, 338) separating member 34 and blade 48, this last being movable to a circuit-making position at which the contacts 40, 58 are in engagement; a torsion spring 78 (278, 378) settable to a biased condition while latching blade 48 in the circuit-making position via an insulating member (strip 54 or cap 289), and a fusible pin 84 blocking spring 78 where it latches blade 48. Further, the description contemplates that the angled member 34 (334) or the blade 234 may form an integral part of a resilient arm 28 (228, 328) of a thermostatic switch assembly, and that blade 248 may have a root section 247 mounted side-by-side with the other components of the thermostatic switch assembly.

While the foregoing description has disclosed the switch elements of overtemperature protectors 42 (et al) as including an extension 34 to make/break blade 28 of thermostat 18, it will be clear to those skilled in the art that the exact location is not critical—e.g., an extension on regulator blade 30 supporting the switch elements 38, 40, 46, 48, 58 would be equally applicable. Likewise, the torsion spring 68 could be supported on the upstanding portion 20 of bracket 10, as long as some portion of arm 278 latches blade 48 in the closed circuit condition with pin 84 blocking arm 278 in appropriate fashion. Other modifications of this nature will be evident to those skilled in the art and these too are intended to fall within the scope of the invention. The presently disclosed embodiments are therefore to be considered in all respects as illustrative and not restrictive, the scope of the invention being defined by the appended claims rather than by the foregoing description, and all changes which come within the meaning and range of equivalency of the claims are therefore intended to be embraced therein.

What is claimed is:

1. In an electrical appliance having a heating element, an overtemperature protector comprising a contact-bearing member and a resilient blade having thereon a further contact, one of said member and said blade being adapted to be connected to a source of electrical power and the other being adapted to be connected in circuit with the heating element of the appliance; a thermally conductive support adapted to be in thermal communication with the heating element, means on said support holding the member and the blade in electrically insulated relationship, said further contact being fastened to the blade in opposed, spaced relationship with said first-mentioned contact and settable into a normal current-carrying engagement with the first-mentioned contact by stressing the blade toward the first-mentioned contact; a torsion spring mounted on said support and having a fixed arm abutting said support and a mobile arm, said mobile arm being movable from a rest position clear of the blade to a flexed position with the end of said mobile arm immediately adjacent the blade at a point thereon remote from said holding means; electrical insulator means intervening between said point on the blade and the end of the mobile arm; said end of the mobile arm being effective to engage the blade through said intervening insulator means, thereby holding said contacts in current-carrying engagement when the blade is stressed and in response to moving the mobile arm to said flexed position; and a thermally fusible pin affixed in heat exchange relationship to the support and blocking the mobile arm in the flexed position, whereby excessive heating of said pin allows the torsion spring to shear the pin and release the blade to open said contacts.

2. The overtemperature protector defined in claim 1, wherein said support is a bracket with a base and an upstanding portion, said holding means for said member and said blade being carried by said upstanding portion, whereas said torsion spring and fusible pin are carried by said base.

3. The overtemperature protector defined in claim 1, wherein said end of the mobile arm is formed at a right angle to the mobile arm and parallel to said blade.

4. The overtemperature protector defined in claim 3, wherein said holding means includes a member having a substantially right angled bend therein at one end thereof and an electrically insulating switch body secured to said right angled bend proximate said one end, and a particular one of said contacts derives support from said switch body at a point remote from said right angled bend.

5. The overtemperature protector defined in claim 4, wherein said switch body has at least one side, said resilient blade and said right angled bend are both fastened to said one side.

6. The overtemperature protector as defined in claim 5, wherein said right angled bend of the holding means and said resilient blade are both secured to one end of said switch body, whereas said contact bearing member is secured to the other end of the switch body.

7. The overtemperature protector defined in claim 3 or claim 6, wherein said insulating material overlies said formed end of the mobile arm.

8. The overtemperature protector defined in claim 5, wherein said member having a right angled bend is comprised in said contact-bearing member and one end of said switch body is fastened thereto by the electrical contact on said contact-bearing member, whereas said resilient blade is riveted to the other end of the switch body.

9. The overtemperature protector defined in claim 3 or claim 8, wherein said insulating material in an extension secured to said resilient blade.

10. The overtemperature protector defined in claim 1, wherein said member bearing the first-mentioned electrical contact is identical to said resilient blade.

11. In an electrical appliance having a heating element and a thermostat controlling the supply of electrical power from a source to said heating element, said thermostat comprising a thermally conductive support in thermal communication with said heating element, electrical insulation means on said support holding a control member, regulator blade positionable by the control member, a make/break blade normally cooperating with said regulator blade to establish a closed circuit, and a temperature-sensitive strip deformable to interrupt the cooperation between said normally cooperating blades, thereby opening said closed circuit; said strip being in thermal communication with said support; the combination in series circuit therewith of:

(a) an extension projecting from a discrete one of said make/break blade and said regulator blade, (b) an electrically insulating switch body affixed to said extension and supporting a pair of contacts in spaced movable relation to one another, one contact of said pair adapted for connection to the source of electrical power and the other contact being in electrical communication with said extension, (c) a resilient blade secured to said switch body and bearing a particular one of said contacts, said resilient blade being operable to bring said contacts into electrical communication when flexed to a discrete position, (d) a torsion spring having a mobile arm biasable to move from a first position free of the resilient blade to a second position in latching relationship therewith when the resilient blade is in said discrete position, (e) electrical insulator means intervening between the resilient blade and the mobile arm of said torsion spring when in said discrete position and said second position, respectively; said latching relationship being effected through said intervening insulator means, (f) a thermally fusible pin affixed in heat exchange relationship to the thermostat support and blocking said torsion spring in the second position, whereby supply of power to said heating element is cutoff when said fusible pin is softened by excessive heating and sheared by said torsion spring to open said contacts.

12. The combination defined in claim 11, wherein said support is a bracket with a base and an upstanding portion, said control member and said discrete ore blade being carried by said upstanding portion whereas said torsion spring and fusible pin are carried by said base.

13. The overtemperature protector defined in claim 11, wherein said torsion spring has an end formed at a right angle to the mobile arm and parallel to said resilient blade, said formed end providing said latching relationship.

14. The overtemperature protector defined in claim 13, wherein said extension has a substantially right angled bend therein at one end and said electrically insulating switch body is secured to said right angled bend proximate said one end.

15. The combination defined in claim 14, wherein said right angled bend of said extension and said resilient blade are both fastened to one end of said switch body, whereas said one contact is fastened to the other one end of the switch body.

16. The combination defined in claim 13 or claim 15, wherein said electrical isolating means overlies said formed end of the mobile arm.

17. The combination defined in claim 14, wherein said switch body has a side, said resilient blade and said right angled bend both being fastened to said side.

18. The combination defined in claim 17, wherein one end of said switch body is fastened to said right angled bend of said extension by one of said pair of contacts whereas said resilient blade is riveted to the other end of the switch body.

19. The combination defined in claim 13 or claim 18, wherein said isolation means is an extension secured to said resilient blade.

* * * * *